US011815096B2

(12) United States Patent
Mandallaz et al.

(10) Patent No.: US 11,815,096 B2
(45) Date of Patent: Nov. 14, 2023

(54) PUMP UNIT

(71) Applicant: PFEIFFER VACUUM, Annecy (FR)

(72) Inventors: Eric Mandallaz, Annecy (FR); Thibaut Bourrilhon, Trevignin (FR); Christophe Santi, Giez (FR)

(73) Assignee: PFEIFFER VACUUM, Annecy (FR)

( * ) Notice: Subject to any disclaimer, the term of this patent is extended or adjusted under 35 U.S.C. 154(b) by 129 days.

(21) Appl. No.: 17/626,634

(22) PCT Filed: Jun. 24, 2020

(86) PCT No.: PCT/EP2020/067619
§ 371 (c)(1),
(2) Date: Jan. 12, 2022

(87) PCT Pub. No.: WO2021/008834
PCT Pub. Date: Jan. 21, 2021

(65) Prior Publication Data

US 2022/0299030 A1 Sep. 22, 2022

(30) Foreign Application Priority Data

Jul. 17, 2019 (FR) ..... 19 08088

(51) Int. Cl.
*F04C 25/02* (2006.01)
*F04C 23/00* (2006.01)
(Continued)

(52) U.S. Cl.
CPC ..... *F04C 25/02* (2013.01); *F04C 18/126* (2013.01); *F04C 23/001* (2013.01); *F04C 28/26* (2013.01);
(Continued)

(58) Field of Classification Search
CPC ..... F04C 25/02; F04C 18/126; F04C 23/001; F04C 28/26; F04C 29/0085;
(Continued)

(56) References Cited

U.S. PATENT DOCUMENTS 3,922,110 A * 11/1975 Huse ..... F04B 9/02 60/431
7,140,846 B2 * 11/2006 Yamamoto ..... F04C 23/001 417/423.1
(Continued)

FOREIGN PATENT DOCUMENTS

DE 20 2014 005 481 U1 7/2014
GB 2528450 A 1/2016
(Continued)

OTHER PUBLICATIONS

International Search Report dated Jul. 30, 2020 in PCT/EP2020/067619 filed on Jun. 24, 2020, (3 pages).

*Primary Examiner* — J. Todd Newton
(74) *Attorney, Agent, or Firm* — Oblon, McClelland, Maier & Neustadt, L.L.P.

(57) ABSTRACT

A pump unit includes a rough-vacuum pump and a Roots vacuum pump connected in series and upstream of the rough-vacuum pump in the direction of flow of the pumped gases. The Roots vacuum pump has three pumping stages in which the rotors are designed to be driven simultaneously in rotation by a motor of the Roots vacuum pump. A ratio of the flow rate generated by the first pumping stage of the rough-vacuum pump in the direction of flow of the pumped gases over the flow rate generated by the last pumping stage of the rough-vacuum pump is less than or equal to four.

14 Claims, 2 Drawing Sheets

(51) Int. Cl.
*F04C 28/26* (2006.01)
*F04C 18/12* (2006.01)
*F04C 29/00* (2006.01)

(52) U.S. Cl.
CPC ..... *F04C 29/0085* (2013.01); *F04C 2220/12* (2013.01); *F04C 2240/102* (2013.01); *F04C 2240/20* (2013.01); *F04C 2240/40* (2013.01)

(58) Field of Classification Search
CPC ..... F04C 2220/12; F04C 2240/102; F04C 2240/20; F04C 2240/40; F04C 2240/803; F04C 28/08; F04C 23/02
USPC ..... 418/9
See application file for complete search history.

(56) References Cited

U.S. PATENT DOCUMENTS

2002/0131870 A1* 9/2002 Puech ..... F04B 45/04 417/205
2002/0155014 A1* 10/2002 Durand ..... F04C 18/086 418/9
2004/0173312 A1* 9/2004 Shibayama ..... F16K 15/042 156/345.29
2007/0104587 A1* 5/2007 Kawamura ..... F01C 21/007 417/247
2012/0219443 A1* 8/2012 Neel ..... F04D 25/16 418/5
2012/0251368 A1* 10/2012 Stephens ..... F04C 23/001 418/6
2017/0204858 A1* 7/2017 Holbrook ..... F04C 18/126
2018/0149156 A1* 5/2018 Shaw ..... F04C 28/02
2020/0191147 A1 6/2020 D'Harboulle
2021/0054841 A1* 2/2021 Ding ..... F04C 29/0078
2021/0054843 A1* 2/2021 Crochet ..... B60T 8/885
2022/0299030 A1* 9/2022 Mandallaz ..... F04C 28/08

FOREIGN PATENT DOCUMENTS

WO WO 2004/090332 A1 10/2004
WO WO 2018/010970 A1 1/2018
WO WO 2018/184853 A1 10/2018

* cited by examiner

PUMP UNIT

The present invention relates to a pump unit comprising a rough-vacuum pump and a Roots vacuum pump arranged in series upstream of the rough-vacuum pump.

Rough-vacuum pumps have a plurality of pumping stages arranged in series, in which a gas to be pumped flows between a suction side and a discharge side. Known rough-vacuum pumps can be "Roots" pumps, which have two or three rotary lobes, or "claw" pumps, which have two claws.

Rough-vacuum pumps have two rotors with identical profiles turning inside a stator in opposite directions. During rotation, the gas being pumped is trapped in the free space formed by the rotors and the stator, and is driven by the rotors to the following stage, then gradually to the discharge side of the vacuum pump. The pump works with no mechanical contact between the rotors and the stator, which obviates the need to use oil in the pumping stages.

To increase pumping efficiency, in particular flow rate, a Roots vacuum pump, also known as a Roots blower, is mounted in series and upstream of the rough-vacuum pump. The flow rate generated by the Roots vacuum pump may be approximately twenty times the flow rate generated by the rough-vacuum pump. This vacuum pump usually has one or two pumping stages and a motor to drive the rotors in rotation at a rotational frequency usually greater than the rotational frequency of the motor of the rough-vacuum pump.

The rough-vacuum pump is usually the first component of the pump unit to fail. This is also the most costly component. Indeed, rough-vacuum pumps are subjected to numerous stresses, notably thermal and mechanical, since rough-vacuum pumps provide the highest compression ratio guaranteeing low ultimate vacuum pressures (in the absence of pumped flows) and satisfactory pumping speeds to adequately relieve the Roots vacuum pumps.

To guarantee this high compression ratio, rough-vacuum pumps have a significant number of pumping stages, in most cases between five and seven. These pumps must also be designed to guarantee controlled operational clearances between the rotors and with the stator.

Moreover, since the pressure of the gases pumped by the rough-vacuum pumps are higher than in Roots vacuum pumps, the risk of corrosive attack is greater for rough-vacuum pumps, notably in the final pumping stages.

It is also difficult to optimize the frequencies of vacuum pumps to save energy. It is in fact known to lower the rotational frequency in waiting phases, referred to as ultimate vacuum phases, to reduce the electricity consumption of the vacuum pump. However, it is only possible to modify the frequency of all of the pumping stages of the rough-vacuum pump simultaneously, since the rotors are driven by the same motor. An excessive reduction of the rotational frequency of the rough-vacuum pump can therefore result in a significant loss of pumping performance, which limits efficiency.

One of the objectives of the present invention is to provide an improved pump unit that at least partially overcomes one of the drawbacks in the prior art.

For this purpose, the invention relates to a pump unit comprising a rough-vacuum pump and a Roots vacuum pump connected in series and upstream of the rough-vacuum pump in the direction of flow of the pumped gases, characterized in that:

- the Roots vacuum pump has three pumping stages in which the rotors are designed to be driven simultaneously in rotation by a motor of the Roots vacuum pump, and
- the ratio of the flow rate generated by the first pumping stage of the rough-vacuum pump in the direction of flow of the pumped gases over the flow rate generated by the last pumping stage of the rough-vacuum pump is less than or equal to four.

Said ratio is for example less than or equal to three, for example two.

Using a Roots vacuum pump with three pumping stages "moves" a pumping stage of the rough-vacuum pump in the prior art to the Roots vacuum pump. The first pumping stage of the rough-vacuum pump becomes the last pumping stage of the Roots vacuum pump. In fact, said stage can notably turn faster as a result of being driven by the motor of the Roots vacuum pump.

This transfer of the pumping stage helps to significantly reduce the compression ratio of the rough-vacuum pump, and consequently the stresses exerted on the rough-vacuum pump, said stresses being partially moved to the Roots vacuum pump. This makes it possible to lengthen times between maintenance on the rough-vacuum pump. Since the Roots vacuum pump operates at lower pressure, these stresses are less critical.

In particular, a low compression ratio enables the bending stresses exerted on the shafts to be reduced. This enables the centre-to-centre distance between the shafts carrying the rotors to be reduced, which helps to reduce the size of the rough-vacuum pump. A smaller rough-vacuum pump helps to reduce costs as a result of needing less material, and the costs of surface treatments, such as nickel plating, and transport costs, in particular air freight, are reduced.

This also provides a high priming torque to restart the stopped rough-vacuum pump, notably when pumping substances liable to be deposited on the moving parts of the rough-vacuum pump.

A low compression ratio in the rough-vacuum pump also enables a motor of lesser power to be used.

Lowering the thermal and mechanical stresses caused by the low compression ratio of the rough-vacuum pump also helps to enhance the reliability of the rough-vacuum pump. This makes it possible to increase the rotational frequency, for example to enable the rough-vacuum pump to absorb higher gas flows or to reduce the dimensions of the pumping stages and therefore the size of the rough-vacuum pump.

Such a rough-vacuum pump with a low compression ratio is not standard. Said rough-vacuum pump is specific to the pump unit since it cannot operate alone as a conventional rough-vacuum pump, but is especially designed to operate downstream of a Roots vacuum pump with three pumping stages according to the invention.

The pump unit can also have one or more of the features described below, taken individually or in combination.

The rough-vacuum pump has for example at least three pumping stages, for example three to five, or three or four, in which the rotors are designed to be driven simultaneously in rotation by a motor of the rough-vacuum pump.

The flow rate generated by the first pumping stage of the rough-vacuum pump is for example less than or equal to 500 $m^3/h$, for example between 200 $m^3/h$ and 300 $m^3/h$.

The flow rate generated by the first pumping stage of the Roots vacuum pump is for example ten times greater, or twenty times greater, than the flow rate generated by the first pumping stage of the rough-vacuum pump.

According to an example embodiment, the flow rate generated by the first pumping stage of the Roots vacuum pump is for example greater than 5000 $m^3/h$, for example 6000 $m^3/h$.

According to an example embodiment, the flow rate generated by the first pumping stage of the Roots vacuum pump is for example between 2100 $m^3/h$ and 3500 $m^3/h$. The flow rate generated by the second pumping stage of the Roots vacuum pump is for example between 447 $m^3/h$ and 744 $m^3/h$. The flow rate generated by the third (and last) pumping stage of the Roots vacuum pump is for example between 298 $m^3/h$ and 496 $m^3/h$.

The flow rate generated by the first pumping stage of the rough-vacuum pump is for example between 248 $m^3/h$ and 298 $m^3/h$. The flow rate generated by the second pumping stage of the rough-vacuum pump is for example between 124 $m^3/h$ and 149 $m^3/h$. The flow rate generated by the third pumping stage of the rough-vacuum pump is for example between 124 $m^3/h$ and 149 $m^3/h$.

According to an example embodiment, the pump unit includes a frame carrying the Roots vacuum pump and the rough-vacuum pump on top of one another, the rough-vacuum pump being arranged above the Roots vacuum pump. Spatially arranging the Roots vacuum pump beneath the rough-vacuum pump lowers the centre of gravity of the pump unit, which notably helps to enhance the stability thereof.

According to another example embodiment, the pump unit 1 includes a frame carrying the Roots vacuum pump and the rough-vacuum pump on top of one another, the Roots vacuum pump being arranged above the rough-vacuum pump.

The motor of the rough-vacuum pump can be designed to be variable to generate a high rotational frequency, for example greater than 100 Hz, and/or a low rotational frequency, for example below 50 Hz, and a nominal rotational frequency between the high rotational frequency and the low rotational frequency. Indeed, the rotational frequency of the rough-vacuum pump can be even more significantly reduced to save energy, notably during the ultimate-vacuum waiting phases, without any risk of losing pumping performance, which is guaranteed by the high compression ratio of the three-stage Roots vacuum pump. The rough-vacuum pump can thus operate over a wide range of rotational frequencies, firstly enabling absorption of significant gas flows at high rotational frequencies, and secondly reducing electricity consumption for zero or negligible flows at low rotational frequencies.

According to an example embodiment, the pump unit has a bypass duct bringing a discharge side of the Roots vacuum pump into communication with a discharge side of the rough-vacuum pump, the bypass duct being fitted with a valve device that is designed to open when the pressure at the suction side of the Roots vacuum pump is greater than a pressure threshold.

The pressure threshold is for example between 400 mbar and 600 mbar, for example 500 mbar.

The valve device is for example a check valve.

The bypass duct thus provides a bypass path from the rough-vacuum pump when pumping high-pressure gases, for example at pressures exceeding 500 mbar. This is made possible by the presence of a third pumping stage on the Roots vacuum pump. This low-flow third stage enables the Roots vacuum pump to operate alone for longer without failing. Such a pump unit, by bypassing the high-pressure rough pumping, helps to increase the high-pressure pumping speed and to reduce electricity consumption and the time required for the pressure drop. This embodiment applies notably to the cyclical pumping of substrate load locks.

Reducing the thermal and mechanical stresses exerted on the rough-vacuum pump can also enable the stator of the pumping stages of the rough-vacuum pump to be at least partially made of two half-shells that are assembled on an assembly surface passing through the axes of the shafts carrying the rotors. Such a pump is quicker to assemble and the risks of misalignment of the different elements of the stator are reduced. Reducing the assembly time of the rough-vacuum pump helps to reduce costs.

Other advantages and features are included in the description of a specific embodiment of the invention, which is in no way limiting, and in the attached drawings, in which.

In these figures, identical elements are indicated using the same reference numbers.

The following embodiments are examples. Although the description refers to one or more embodiments, this does not necessarily mean that each reference refers to the same embodiment, or that the features apply only to one embodiment. Individual features of different embodiments may also be combined or swapped to provide other embodiments.

"Flow rate generated" means the capacity corresponding to the volume formed between the rotors and the stator of the vacuum pump multiplied by the number of revolutions per second.

"Ultimate vacuum" means the lowest pressure obtained for a pumping device when no gas flow to be pumped is injected into the vacuum pump.

A rough-vacuum pump is a volumetric vacuum pump that is designed to use two rotors to aspirate, transfer then discharge the gas being pumped at atmospheric pressure. The rotors are carried on two shafts driven in rotation by a motor of the rough-vacuum pump. The rotors can be Roots, claw or screw rotors.

A Roots-vacuum pump (also known as a Roots blower) is a volumetric vacuum pump that is designed to use two Roots rotors to aspirate, transfer then discharge the gas being pumped. The Roots vacuum pump is mounted upstream of and in series with a rough-vacuum pump. The rotors are carried on two shafts driven in rotation by a motor of the Roots vacuum pump.

The Roots vacuum pump primarily differs from the rough-vacuum pump in the larger dimensions of the pumping stage due to the larger pumping capacities, the larger clearance tolerances, and the fact that the Roots vacuum pump does not discharge at atmospheric pressure, but must be used in series with and upstream of a rough-vacuum pump.

"Upstream" means an element that is placed before another element in relation to the direction of flow of the pumped gases. Conversely, "downstream" means an element that is placed after another element in relation to the direction of flow of the pumped gases, the element located upstream being at a lower pressure than the element located downstream, which is at a higher pressure.

The terms "above" and "below" shall be understood with reference to the arrangement of the elements of a pump unit placed on the floor.

Figure 1:
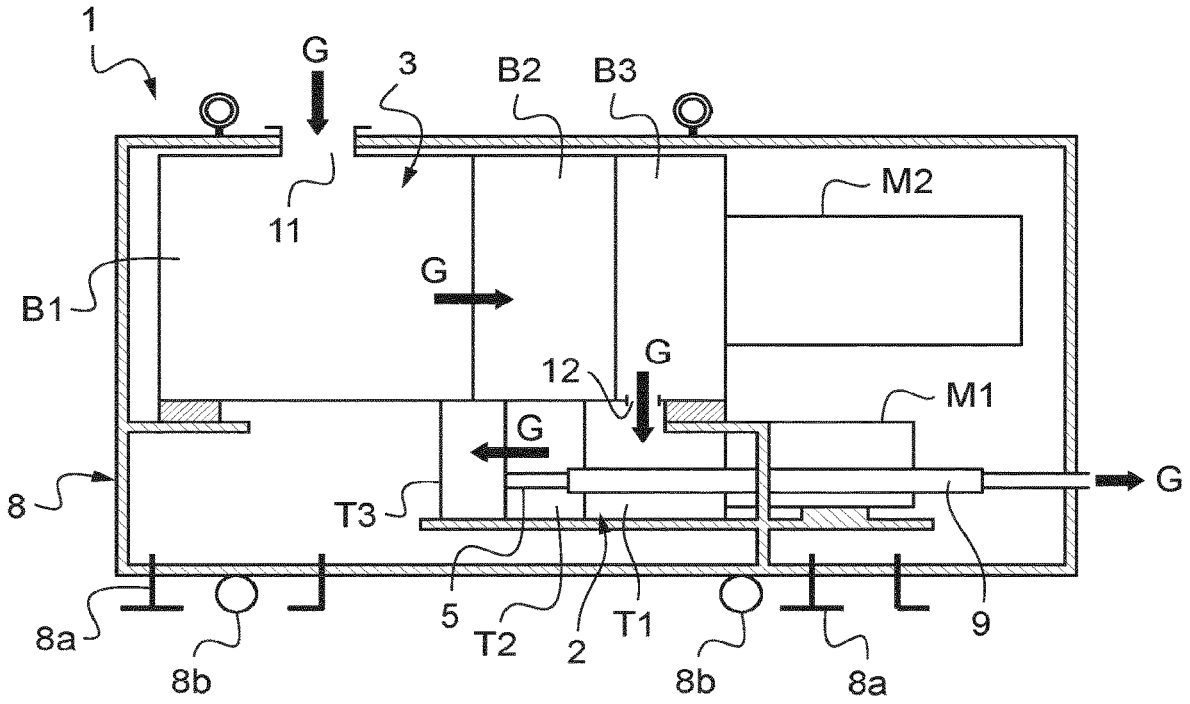
FIG. 1 is a very schematic view of a pump unit according to a first embodiment.

FIG. 1 shows a first example of the pump unit 1.

The pump unit 1 comprises a rough-vacuum pump 2 and a Roots vacuum pump 3.

The rough-vacuum pump 2 is a multi-stage vacuum pump that is designed to discharge the gases being pumped at atmospheric pressure.

The rough-vacuum pump 2 has at least three pumping stages, for example three to five, or three or four pumping stages T1, T2, T3 (three in FIGS. 1 and 2) that are arranged in series between a suction side 4 and a discharge side 5 of the rough-vacuum pump 2, through which a gas to be pumped can flow.

Each pumping stage T1-T3 is formed by a compression chamber formed in a stator 6 of the rough-vacuum pump 2, the compression chamber having a respective inlet and a respective outlet. The successive pumping stages T1-T3 are connected to one another in series by respective inter-stage channels 7 connecting the outlet (or discharge side) of the preceding pumping stage to the inlet (or suction side) of the following stage (see FIG. 2). The inlet of the first pumping stage T1, also known as the low-pressure stage, communicates with the suction side 4 of the rough-vacuum pump 2, and the outlet of the last pumping stage T3, also known as the discharge stage, communicates with the discharge side 5 of the rough-vacuum pump 2.

The rough-vacuum pump 2 also has two rotors 10 arranged inside the pumping stages T1-T3. The shafts of the rotors 10 are driven, for example on the side of the low-pressure stage T1, by a motor M1 of the rough-vacuum pump 2 (FIG. 1). The rotors 10 of the pumping stages T1-T3 are driven simultaneously in rotation by the motor M1 of the rough-vacuum pump 2.

Figure 2:
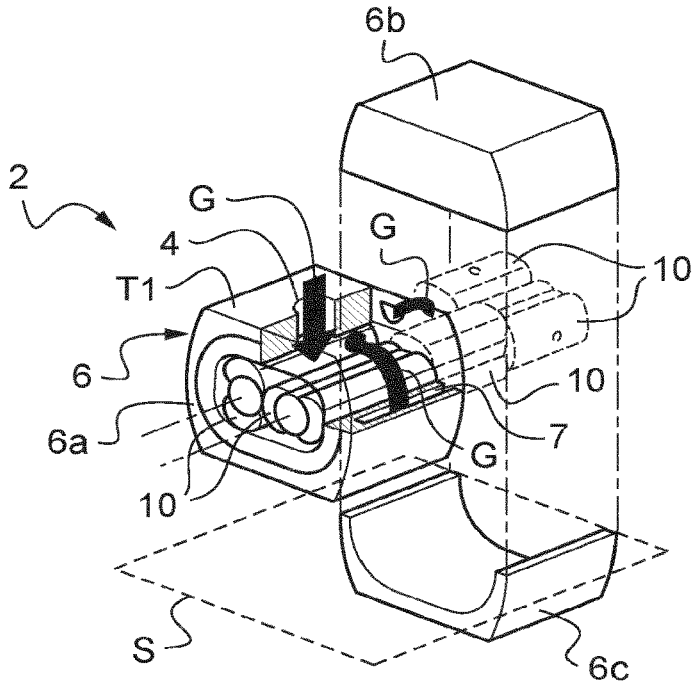
FIG. 2 is a schematic view showing an example embodiment of a rough-vacuum pump, in which only the elements required for operation are shown.

The rotors 10 shown in FIG. 2 are Roots rotors ("figure eight"- or "bean"-shaped section). Naturally, the invention also applies to other types of dry multi-stage rough-vacuum pumps, such as "claw" pumps or spiral pumps or screw pumps or any other similar principle for volumetric vacuum pumps.

The rotors 10 are angularly offset and driven to turn in synchrony in opposite directions in the compression chamber of each stage T1-T3. During rotation, the gas aspirated from the inlet is trapped in the free space formed by the rotors 10 and the stator 6, and is then driven by the rotors 10 to the following stage (the direction of flow of the pumped gases is shown by the arrows G in FIGS. 1 and 2).

The rough-vacuum pump 2 is referred to as "dry" since, when operating, the rotors 10 turn inside the stator 6 with no mechanical contact with the stator 6, which obviates the need to use oil in the pumping stages T1-T3.

The Roots vacuum pump 3 is connected in series with and upstream of the rough-vacuum pump 2 in the direction of flow G of the gases being pumped.

The Roots vacuum pump 3 has three pumping stages B1, B2, B3 (FIG. 1) that are arranged in series between a suction side 11 and a discharge side 12 of the Roots vacuum pump 3, through which a gas to be pumped can flow.

As for the rough-vacuum pump 1, each pumping stage B1-B3 of the Roots vacuum pump 3 is formed by a compression chamber having a respective inlet and a respective outlet. The successive pumping stages B1-B3 are connected to one another in series by respective inter-stage channels connecting the outlet (or discharge side) of the preceding pumping stage to the inlet (or suction side) of the following stage. The inlet of the first pumping stage B1, also known as the low-pressure stage, communicates with the suction side 11 of the Roots vacuum pump 3, and the outlet of the third and last pumping stage B3, also known as the discharge stage, communicates with the discharge side 12 of the Roots vacuum pump 3 and consequently with the suction side 4 of the rough-vacuum pump 2.

The Roots vacuum pump 3 also has two rotors 10 arranged inside the pumping stages B1-B3. The shafts of the rotors 10 are driven, for example on the side of the discharge stage B3, by a motor M2 of the Roots vacuum pump 3 (FIG. 1). The rotors 10 of the pumping stages B1-B3 are driven simultaneously in rotation by the motor M2 of the Roots vacuum pump 3.

The rotors 10 of the Roots vacuum pump 3 are Roots rotors ("figure eight"- or "bean"-shaped section), as shown in the illustration of the rough-vacuum pump 2 in FIG. 2.

The Roots vacuum pump 3 is also a "dry" vacuum pump.

In this first example embodiment, the Roots vacuum pump 3 is arranged above the rough-vacuum pump 2. Said pump is for example carried by a frame 8 of the pump unit 1, which also carries the rough-vacuum pump 2, and the frame 8 can also have feet 8*a* and/or castors 8*b* to enable the vacuum pumps 2, 3 to be moved and stored together, spatially one above the other.

The pumping stages B1-B3, T1-T3 of the two vacuum pumps 2, 3 create a volume, i.e. a volume of pumped gas, that decreases (or remains equal) with the pumping stages, the first pumping stage B1 having the highest generated flow rate and the last pumping stage T3 having the lowest generated flow rate. The discharge pressure of the rough-vacuum pump 2 is atmospheric pressure. The rough-vacuum pump 2 can also have a silencer 9 at the outlet of the last pumping stage T3, in the discharge side 5, as shown in FIG. 1.

Furthermore, the ratio of the flow rate generated by the first pumping stage T1 of the rough-vacuum pump 2 in the direction of flow G of the pumped gases over the flow rate generated by the last pumping stage T3 of the rough-vacuum pump 2 is less than or equal to four, for example equal to or less than three. This ratio is for example two. Such a rough-vacuum pump 2 is not standard. Said rough-vacuum pump is specific to the pump unit 1 since it cannot operate alone as a conventional rough-vacuum pump, but is especially designed to operate downstream of a Roots vacuum pump 3 with three pumping stages B1, B2, B3 according to the invention.

The flow rate generated by the first pumping stage T1 of the rough-vacuum pump 2 is for example less than or equal to 500 $m^3/h$, for example between 200 $m^3/h$ and 300 $m^3/h$.

The flow rate generated by the first pumping stage B1 of the Roots vacuum pump 3 is for example ten times greater, for example twenty times greater, than the flow rate generated by the first pumping stage T1 of the rough-vacuum pump 2.

According to an example embodiment, the flow rate generated by the first pumping stage B1 of the Roots vacuum pump 3 is for example greater than 5000 $m^3/h$, for example 6000 $m^3/h$.

According to an example of staging of the pump unit 1, in the Roots vacuum pump 3, the flow rate generated by the first pumping stage B1 of the Roots vacuum pump 3 is for example between 2100 $m^3/h$ and 3500 $m^3/h$, the flow rate generated by the second pumping stage B2 of the Roots vacuum pump 3 is for example between 447 $m^3/h$ and 744 $m^3/h$, and the flow rate generated by the third and last pumping stage B3 of the Roots vacuum pump 3 is for example between 298 $m^3/h$ and 496 $m^3/h$.

In the rough-vacuum pump 2, the flow rate generated by the first pumping stage T1 of the rough-vacuum pump 2 is for example between 248 $m^3$/h and 298 $m^3$/h. The flow rate generated by the second pumping stage T2 of the rough-vacuum pump 2 is for example between 124 $m^3$/h and 149 $m^3$/h. The flow rate generated by the third pumping stage T3 of the rough-vacuum pump 2 is for example equal to the second pumping stage T2, for example between 124 $m^3$/h and 149 $m^3$/h.

In this example, the ratio of the flow rate generated by the first pumping stage T1 of the rough-vacuum pump 2 over the flow rate generated by the last pumping stage T3 is therefore 2.

Using a Roots vacuum pump 3 with three pumping stages B1, B2, B3 "moves" a pumping stage of the rough-vacuum pump in the prior art to the Roots vacuum pump 3. The first pumping stage of the rough-vacuum pump becomes the last pumping stage of the Roots vacuum pump 3. In fact, said stage can notably turn faster as a result of being driven by the motor M2 of the Roots vacuum pump 3.

This transfer of the pumping stage helps to significantly reduce the compression ratio of the rough-vacuum pump 2, and consequently the stresses exerted on the rough-vacuum pump 2, said stresses being partially moved to the Roots vacuum pump 3. This makes it possible to lengthen times between maintenance on the rough-vacuum pump 2. Since the Roots vacuum pump 3 operates at lower pressure, these stresses are less critical.

In particular, a low compression ratio enables the bending stresses exerted on the shafts to be reduced. This enables the centre-to-centre distance between the shafts carrying the rotors 10 to be reduced, which helps to reduce the size of the rough-vacuum pump 2. A smaller rough-vacuum pump 2 helps to reduce costs as a result of needing less material, and the costs of surface treatments, such as nickel plating, and transport costs, in particular air freight, are reduced.

This also provides a high priming torque to restart the stopped rough-vacuum pump 2, notably when pumping substances liable to be deposited on the moving parts of the rough-vacuum pump 2.

A low compression ratio in the rough-vacuum pump 2 also enables a motor M1 of lesser power to be used.

Lowering the thermal and mechanical stresses caused by the low compression ratio of the rough-vacuum pump 2 also helps to enhance the reliability of the rough-vacuum pump 2. This makes it possible to increase the rotational frequency, for example to enable the rough-vacuum pump 2 to absorb higher gas flows or to reduce the dimensions of the pumping stages and therefore the size of the rough-vacuum pump 2.

Furthermore, dividing the staging of the pump unit 1 in this way makes it easier to play with the frequencies of the two vacuum pumps 2, 3 to save on energy consumed. Indeed, the rotational frequency of the rough-vacuum pump 2 can be even more significantly reduced without any risk of losing pumping performance at ultimate vacuum pressures, which is guaranteed by the high compression ratio of the three-stage Roots vacuum pump 3.

The motor M1 of the rough-vacuum pump 2 can therefore be designed to be variable to generate a high rotational frequency, for example greater than 100 Hz, and/or a low rotational frequency, for example below 50 Hz, and a nominal rotational frequency between the high rotational frequency and the low rotational frequency, the generated flow rates and the ratios described above being defined for the nominal rotational speed.

The rough-vacuum pump 2 can thus operate over a wide range of rotational frequencies, firstly enabling absorption of significant gas flows at high rotational frequencies, and secondly reducing electricity consumption for zero or negligible flows at low rotational frequencies.

Furthermore, a low compression ratio can enable at least part of the stator 6 of the pumping stages T1, T2, T3 of the rough-vacuum pump 2 to be made of two half-shells 6*b*, 6*c* that are assembled on an assembly surface S passing through the axes of the shafts (see for example FIG. 2). The stator 6 of all of the pumping stages of the rough-vacuum pump is for example made of two half-shells. According to another example, only the stator of the final two or three pumping stages T2, T3 is made of two half-shells 6*b*, 6*c*.

Such a pump is quicker to assemble and the risks of misalignment of the different elements of the stator are reduced. Reducing the assembly time of the rough-vacuum pump 2 helps to reduce costs.

Figure 3:
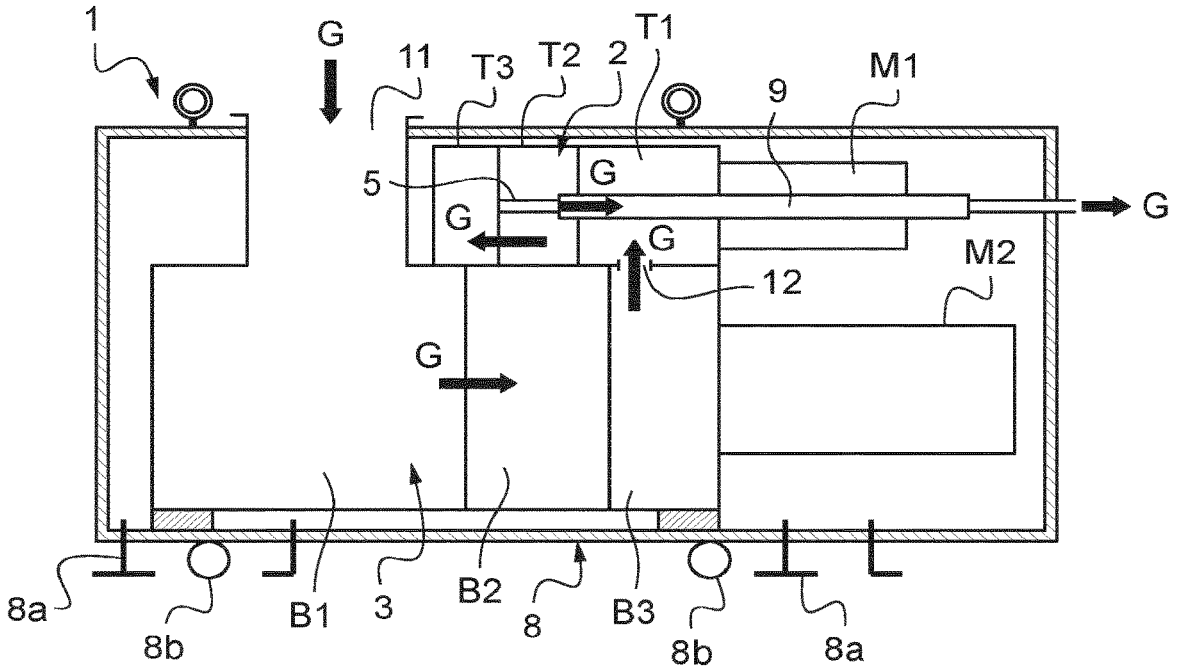
FIG. 3 is a diagram similar to the diagram in FIG. 1 showing a second embodiment of the pump unit.

FIG. 3 shows a second example of the pump unit 1.

This example differs from the preceding example in that in this case the Roots vacuum pump 3 is arranged beneath the rough-vacuum pump 2.

Since the three pumping stages B1-B3 of the Roots vacuum pump 3 are larger than the rough-vacuum pump 2 on account of the larger volume generated by the Roots vacuum pump 3 and, where applicable, the smaller centre-to-centre distance of the rough-vacuum pump 2, the Roots vacuum pump 3 becomes the most voluminous and heaviest component of the pump unit 1.

Spatially arranging the Roots vacuum pump 3 beneath the rough-vacuum pump 2 lowers the centre of gravity of the pump unit 1, which notably helps to enhance the stability thereof.

Figure 4:
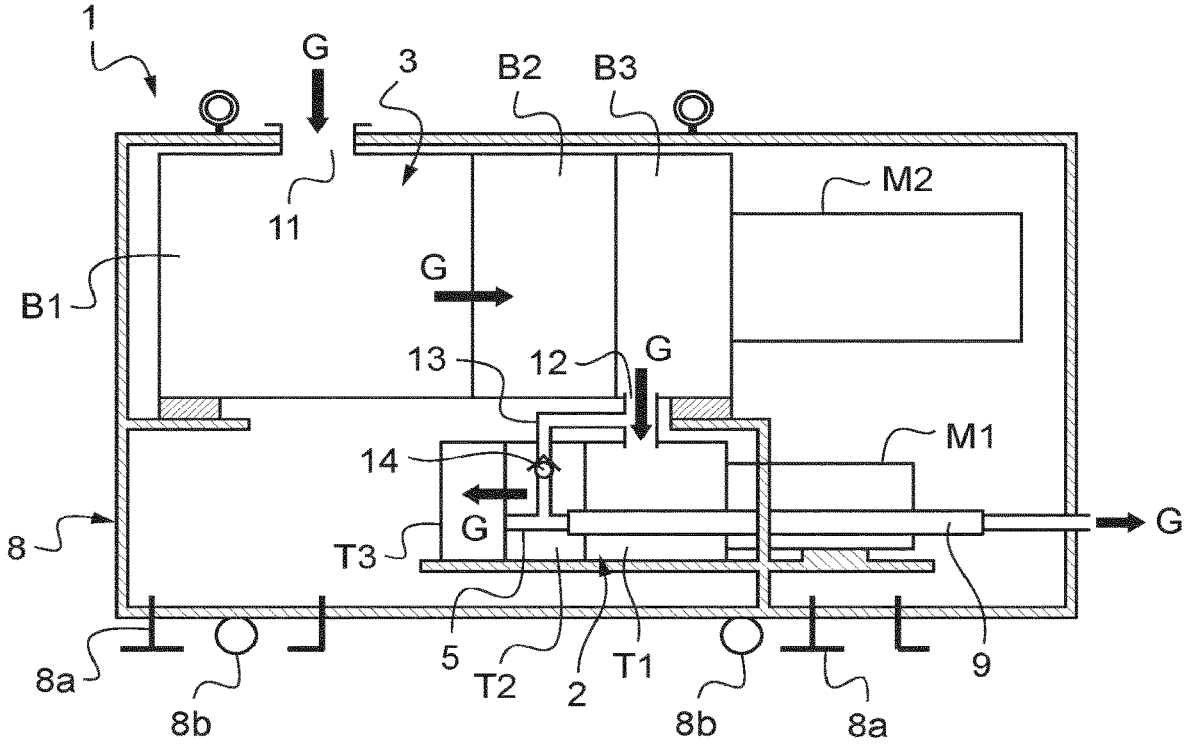
FIG. 4 is a diagram similar to the diagram in FIG. 1 showing a third embodiment of the pump unit.

FIG. 4 shows another example embodiment of the pump unit 1.

In this example, the pump unit 1 has a bypass duct 13 bringing a discharge side 12 of the Roots vacuum pump 3 into communication with a discharge side 5 of the rough-vacuum pump 2. The bypass duct 13 is fitted with a valve device 14 that is designed to open when the pressure at the suction side 11 of the Roots vacuum pump 3 is greater than a pressure threshold.

The pressure threshold is for example between 400 mbar and 600 mbar, for example 500 mbar.

The valve device 14 is for example a check valve. The check valve enables the automatic bypassing of the rough-vacuum pump 2 at the calibration threshold of the check valve. The calibration threshold is set so that the check valve opens when the pressure at the suction side 11 of the Roots vacuum pump 3 is greater than said pressure threshold.

According to another example, the valve device 14 is a controllable valve, for example using data representing a high pressure of the pumped gas, such as a signal from a pressure sensor.

The bypass duct 13 thus provides a bypass path from the rough-vacuum pump 2 when pumping high-pressure gases, for example at pressures exceeding 500 mbar. This is made possible by the presence of a third pumping stage B3 on the Roots vacuum pump 3. The third and last low-flow pumping stage B3 enables the Roots vacuum pump 3 to operate for longer without failing, with no rough pumping. Such a pump unit 1, by bypassing the high-pressure rough pumping, helps to increase the high-pressure pumping speed and to reduce electricity consumption and the time required for the pressure drop.

This embodiment applies notably to the cyclical pumping of substrate load locks. In a known manner, a load lock opens at atmospheric pressure to load at least one substrate, and unloads the substrate into a process chamber after vacuuming. Each time a substrate is loaded, the pressure inside the lock needs to be dropped and then raised. The load locks are notably used for the manufacture of flat panel displays or photovoltaic substrates, or for the manufacture of semiconductor substrates.

The invention claimed is:

1. A pump unit comprising:

a rough-vacuum pump; and a Roots vacuum pump connected in series with and upstream of the rough-vacuum pump in a direction of flow of pumped gases, wherein the Roots vacuum pump has three pumping stages in which the rotors are configured to be driven simultaneously in rotation by a motor of the Roots vacuum pump, and wherein a ratio of a flow rate generated by a first pumping stage of the rough-vacuum pump in the direction of flow of the pumped gases over a flow rate generated by a last pumping stage of the rough-vacuum pump is less than or equal to four.

2. The pump unit according to claim 1, wherein said ratio is less than or equal to three.

3. The pump unit according to claim 1, wherein the rough-vacuum pump has three to five pumping stages in which the rotors are configured to be driven simultaneously in rotation by a motor of the rough-vacuum pump.

4. The pump unit according to claim 1, wherein the flow rate generated by the first pumping stage of the rough-vacuum pump is less than or equal to 500 $m^3/h$.

5. The pump unit according to claim 1, wherein the flow rate generated by the first pumping stage of the rough-vacuum pump is between 200 $m^3/h$ and 300 $m^3/h$.

6. The pump unit according to claim 1, wherein the flow rate generated by a first pumping stage of the Roots vacuum pump is ten times greater than the flow rate generated by the first pumping stage of the rough-vacuum pump.

7. The pump unit according to claim 1, wherein the flow rate generated by a first pumping stage of the Roots vacuum pump is twenty times greater than the flow rate generated by the first pumping stage of the rough-vacuum pump.

8. The pump unit according to claim 1, wherein the flow rate generated by the first pumping stage of the rough-vacuum pump is between 248 $m^3/h$ and 298 $m^3/h$, the flow rate generated by a second pumping stage of the rough-vacuum pump is between 124 $m^3/h$ and 149 $m^3/h$, and the flow rate generated by a third pumping stage of the rough-vacuum pump is between 124 $m^3/h$ and 149 $m^3/h$.

9. The pump unit according to claim 1, further comprising a frame carrying the Roots vacuum pump and the rough-vacuum pump on top of one another, the rough-vacuum pump being arranged above the Roots vacuum pump.

10. The pump unit according to claim 1, further comprising a frame carrying the Roots vacuum pump and the rough-vacuum pump on top of one another, the Roots vacuum pump being arranged above the rough-vacuum pump.

11. The pump unit according to claim 1, wherein a motor of the rough-vacuum pump is configured to be variable to generate a high rotational frequency and/or a low rotational frequency and a nominal rotational frequency between the high rotational frequency and the low rotational frequency.

12. The pump unit according to claim 11, wherein the high rotational frequency is greater than 100 Hz and the low rotational frequency is less than 50 Hz.

13. The pump unit according to claim 1, further comprising a bypass duct bringing a discharge side of the Roots vacuum pump into communication with a discharge side of the rough-vacuum pump, the bypass duct being fitted with a valve device that is configured to open when the pressure at a suction side of the Roots vacuum pump is greater than a pressure threshold.

14. The pump unit according to claim 1, wherein a stator of the pumping stages of the rough-vacuum pump is at least partially made of two half-shells that are assembled on an assembly surface passing through axes of shafts carrying the rotors.

* * * * *